United States Patent [19]

Kikuchi

[11] Patent Number: 4,789,008

[45] Date of Patent: Dec. 6, 1988

[54] CREEL FOR LOOM

[75] Inventor: Koichi Kikuchi, Shimada, Japan

[73] Assignee: Kikuchi Kogyo Co., Ltd., Tokyo, Japan

[21] Appl. No.: 39,068

[22] Filed: Apr. 16, 1987

[30] Foreign Application Priority Data

Aug. 30, 1985 [JP] Japan ..... 60-189847

[51] Int. Cl.[4] ..... D02H 1/00; B65H 49/32; D01H 7/52; D03J 1/00

[52] U.S. Cl. ..... 139/97; 28/172; 57/59; 57/75; 57/90; 242/131; 242/131.1

[58] Field of Search ..... 242/131, 131.1; 139/97; 57/59–62, 66–71, 75, 90; 28/172

[56] References Cited

U.S. PATENT DOCUMENTS

| | | | |
|---|---|---|---|
| 2,251,311 | 8/1941 | Wylde et al. | 57/59 |
| 2,897,647 | 8/1959 | Woods et al. | 57/60 |
| 3,167,902 | 2/1965 | Smith et al. | 57/60 X |
| 4,366,935 | 1/1983 | Maria | 57/75 X |

FOREIGN PATENT DOCUMENTS

| | | |
|---|---|---|
| 61-19742 | 5/1986 | Japan . |
| 61-19747 | 5/1986 | Japan . |

*Primary Examiner*—John Petrakes

*Attorney, Agent, or Firm*—Lowe, Price, LeBlanc, Becker & Shur

[57] ABSTRACT

A creel which can deliver untwisted yarns from bobbins in a weaving machine while at a same time twisting them or else twisting some of such untwisted yarns in the S twist and the remaining untwisted yarns in the Z twist with relative low investment for equipments. The creel employs a mechanism similar to a ring twisting mechanism and includes a required number of spindles for rotating bobbins supported thereon, a ring secured in a concentrical relationship to each of the spindles, a traveler mounted for movement on each of the rings, and a driving device for driving the spindles to rotate in a clockwise or counterclockwise direction such that when the untwisted yarns are unwound from the bobbins via the travelers, a twist in the S or Z direction may be applied to the untwisted yarns at a same time.

8 Claims, 3 Drawing Sheets

CREEL FOR LOOM

BACKGROUND OF THE INVENTION

This invention relates to a creel of the type which includes a twisting mechanism.

Conventionally, in producing various belt-formed textile fabrics such as safety belts, one of three methods is selectively employed including a method that a required number of warp yarns wound on a beam are used to weave a textile fabric therewith, another method that twisted yarns wound on bobbins mounted on a creel are supplied from the creel as warp yarns to a weaving machine, and a further method that untwisted yarns (filament yarns) wound on bobbins mounted on a creel are supplied from the creel as warp yarns as they are to a weaving machine is employed.

Of the methods described above, the second method wherein twisted yarns are used as warp yarns for weaving has following problems. In particular, twisting of yarns is not normally conducted by a textile fabric maker but is conducted by an external twisting manufacturer at a request of such a textile fabric maker, and although it is sometimes necessary to change the degree of twist of yarns in accordance with an appearance required for an intended textile fabric, it is inconveniently impossible to change the degree of twist in the course of a weaving process. Further, twisted yarns wound on individual bobbins may not always be of the same length and may vary in length, and in such a case, the twisted yarns may be partly wasted. Besides, twisted yarns wound on bobbins are normally greater in length than raw yarns on large packages, and accordingly time must be taken to splice twisted yarns to each other in the course of a weaving process and such spliced portions of twisted yarns will make a product which is partly bad at a portion thereof containing such spliced portions which must be abandoned. In addition, there are disadvantages that a rewinding step after twisting of yarns and, where warp yarns are to be wound on a beam, a warping step are required, and that the operability is low due to distortion of twisted yarns caused by untwisting of the same, and so on.

Meanwhile, in case untwisted yarns are supplied as warp yarns from a creel directly for weaving, because raw yarns of large packages are used as they are, little time is required to splice such raw yarns to each other in the course of a weaving process, and a rewinding step and a warping step are unnecessary and besides there is no necessity of sending raw yarns to a twisting manufacturer in order to have such raw yarns twisted by the manufacturer. From those reasons, the efficiency in production is very high comparing with the former method described above. However, products have some defects in quality such that they are also limited in appearance and are low in resiliency and in wear resistance. Further, since yarns are not in a twisted state during weaving, filaments of such yarns will not be bundled together well so that the yarns may be broken and fluffed readily. Accordingly, in worst cases, the weaving machine may have to be stopped in order to restore the machine to its normal running condition.

In order to resolve the problems described above, the applicant has proposed in Japanese patent application No. 57-029084 a creel which comprises a twisting mechanism provided for each of a bobbin on which an untwisted yarn is wound whereby the untwisted yarns are delivered from the bobbins to a weaving machine while they are being twisted at a same time.

According to the proposed creel, a relatively complicate mechanism similar to a flyer mechanism is employed for the twisting mechanism. This results in high cost of equipment because such a twisting mechanism is provided for each of a large number of bobbins on a creel, and for example where two seat belts are woven at a same time, about 600 to 700 bobbins are provided for a single creel. Accordingly, provision of such a large number of twisting mechanisms is not practical. Rather, use of twisted yarns is more practical so far as the workability and the cost are concerned.

SUMMARY OF THE INVENTION

It is an object of the present invention to provide a creel which can deliver untwisted yarns from bobbins to a weaving machine while at a same time twisting them with relatively low investment for equipments.

It is another object of the invention to provide a creel which can deliver untwisted yarns from bobbins to a weaving machine while at a same time twisting some of such untwisted yarns in the S twist and the remaining untwisted yarns in the Z twist with relative low investment for equipments.

In order to attain the objects, according to the present invention, a mechanism similar to a ring twisting mechanism which is simpler in construction and lower in production cost than a flyer mechanism is employed as a twisting mechanism provided for each bobbin.

In particular, according to one aspect of the present invention, there is provided a creel for mounting thereon a required number of bobbins on which untwisted yarns are wound which are to be drawn out from the bobbins and supplied to a weaving machine, comprising: a required number of spindles for rotating the bobbins supported thereon in a direction to unwind the yarns from the bobbins; a ring secured in a concentrical relationship to each of said spindles; a traveler mounted for movement on each of the rings; and a driving device for driving said spindles to rotate such that when the untwisted yarns are unwound from the bobbins via said travelers, a twist may be applied to the untwisted yarns at a same time. Accordingly, there is no necessity of using twisted yarns in the creel, and hence various disadvantages which may possibly be resulted from use of twisted yarns such as, for example, waste of yarns, a troublesome operation to splice yarns to each other in the course of weaving and a low operability due to rewinding tendencies of yarns themselves, can be eliminated. Further, a rewinding step and a warping step after twisting of yarns can be omitted, which will result in improvement in production efficiency. Besides, a significant increase in cost due to installation of twisting mechanisms can be avoided.

According to another aspect of the invention, there is provided a creel for mounting thereon a required number of bobbins on which untwisted yarns are wound which are to be drawn out from the bobbins and supplied to a weaving machine, comprising: a required number of spindles for rotating the bobbins supported thereon; a ring secured in a concentrical relationship to each of said spindles; a traveler mounted for movement on each of the rings; and a driving device for driving ones of said spindles to rotate in a clockwise direction such that when the untwisted yarns are unwound from those of the bobbins supported on said ones of said spindles via the associated travelers, the S twist may be applied at a same time to the untwisted yarns thus unwound and for driving the remaining ones of said spindles to rotate in a counterclockwise direction such that when the untwisted yarns are unwound from those of the bobbins supported on said the remaining ones of said spindles via the associated travelers, the Z twist may be applied at a same time to the untwisted yarns thus unwound. Accordingly, similar effects to those described above can be attained. In addition, yarns of the S twist and yarns of the Z twist can be used correctly at a same time, and a product which is free from distortion can be obtained readily.

While the weight (length) of a yarn wound on a bobbin is conventionally smaller, where twisted yarns are used, than that of a yarn on a large package supplied from a raw yarn maker, the present invention presents an advantage that a large package yarn can be used as it is. Further, while a yarn such as a multi-filament yarn must be processed to prevent distortion thereof because otherwise a yarn will be distorted by its rewinding tendency if a relatively strong twist is applied to it, the present invention eliminates the necessity of such processing for distortion prevention, and accordingly the operability is not deteriorated. Besides, since the invention allows yarns twisted to a desired degree to be supplied to a weaving machine, a product of a good appearance which is tough against abrasion can be produced, and the product can be of a higher quality without roughening of yarns comparing with a product produced using twisted yarns.

In addition, since the driving device in the creel of the invention is designed to allow variation of the rotational speed or frequency of the spindles, alteration of the degree of twist which cannot conventionally be done in the course of a weaving process can be made readily, which enables improvements in appearance of products.

The above and other objects, features and advantages of the present invention will become apparent from the following description and the appended claims, taken in conjunction with the accompanying drawings.

DETAILED DESCRIPTION OF THE PREFERRED EMBODIMENTS

Figure 1:
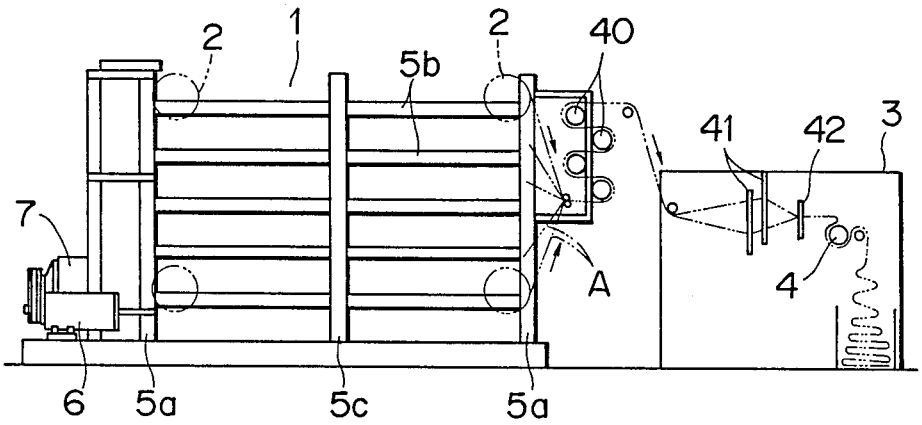
FIG. 1 is a front elevational view showing general construction of a creel according to the present invention.

Referring first to FIG. 1, a creel shown includes a creel body 1 on which a large number of bobbins 2 having untwisted yarns wound thereon are mounted, and a weaving machine 3 including a take-up roller 4 is arranged adjacent the creel body 1.

The creel body 1 includes a pair of vertical frames 5*a* and a plurality of (5 in the embodiment shown) horizontal frames 5*b* mounted in a vertically equidistantly spaced relationship on and extending between the vertical frames 5*a* through an intermediate vertical frame 5*c*. Each of the horizontal frames 5*b* has a plurality of bobbins 2 mounted in a juxtaposed relationship thereon, and an untwisted yarn A (filament yarn) is supplied from each of the bobbins 2 as a warp yarn to the weaving machine 3.

Located adjacent one side (left-hand side in FIG. 1) of the creel body 1 are a motor 6 and a speed change gear 7 for changing the rotational speed of the motor 6. A belt 8 extends between the motor 6 and the speed change gear 7, and a pulley 10 is secured to an output power shaft 9 of the speed change gear 7 (refer to FIG. 2). Thus, rotation transmitted to the pulley 10 via the speed change gear 7 from the motor 6 is further transmitted via belts 11, 12, 13 shown in FIG. 3 and intermediate pulleys 14, 15, 16 located at a substantially mid height of the one side of the creel body 1 as shown in FIG. 2 to pulleys 18 secured to spindle driving shafts 17 located adjacent and extending along the individual horizontal frames 5*b* so that the spindle driving shafts 17 are driven to rotate thereby.

Figure 2:
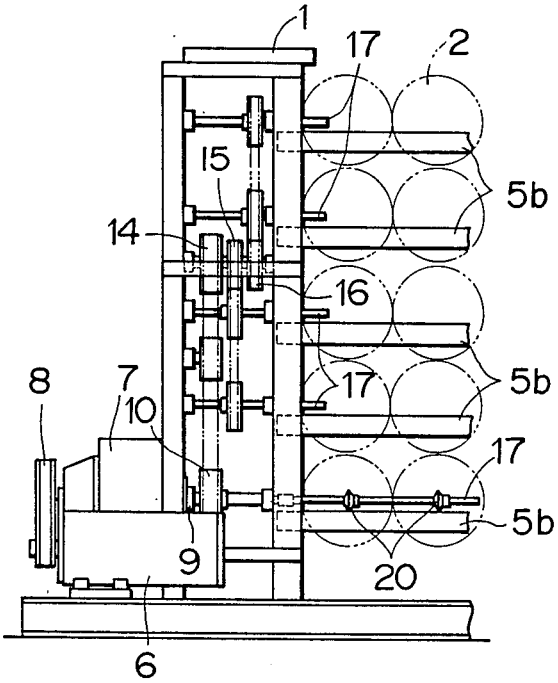
FIG. 2 is an enlarged partial front elevational view of the creel of FIG. 1.
Figure 4:
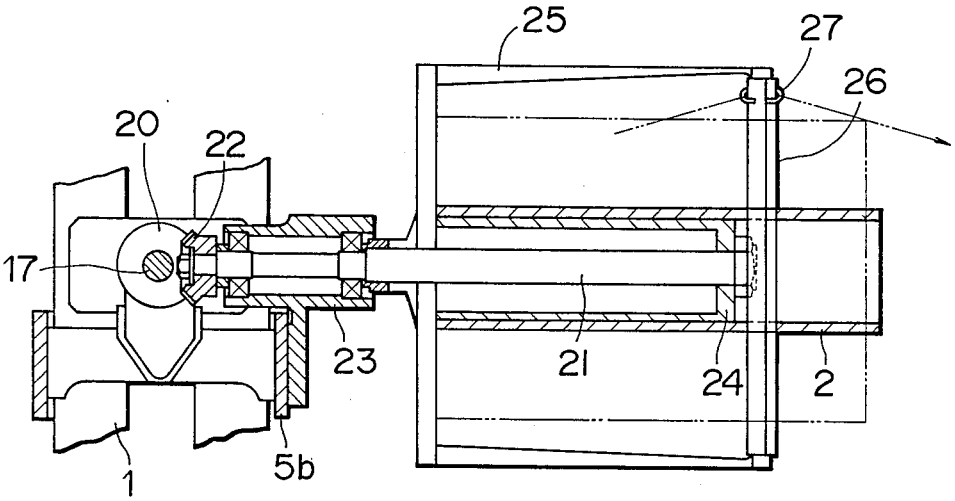
FIG. 4 is an enlarged side elevational view, partly in section, of part of the creel of FIG. 1.

Each of the spindle driving shafts 17 has a plurality of bevel gears 20 mounted at positions thereof corresponding to the individual bobbins 2 as shown in FIGS. 2 and 4. As shown in FIG. 4, each of the bevel gear 20 is held in meshed engagement with another bevel gear 22 secured to an end portion (left end in FIG. 4) of a corresponding one of spindles 21.

Each of the spindles 21 is supported by means of a bearing member 23 secured to the associated horizontal frame 5*b* such that it extends in a horizontal direction perpendicular to the associated spindle driving shaft 17 and has secured at the other end portion (right end in FIG. 4) thereof a support tube 24 on which a bobbin 2 is supported. Thus, each bobbin 2 is rotated in a direction to unwind an untwisted yarn thereon (in a direction opposite to the winding direction of the untwisted yarn A) by a rotational driving force transmitted thereto from the motor 6 via the speed change gear 7 and the associated spindle driving shaft 17.

A driving device for driving the spindles 21 is thus constituted from the motor 6, speed change gear 7, belt 8, pulley 10, belts 11 to 13, intermediate pulleys 14 to 16, spindle driving shafts 17, pulleys 18 and bevel gears 20, 22.

Located at an end portion of each of the support tube 24 is a base end of a ring frame 25 which is secured to the associated spindle 21. The ring frame 25 extends toward the other end of the spindle 21 along the spindle 21, and a ring 26 concentrical with the associated bobbin 2 (the support tube 24 and the spindle 21) is secured to the other end portion (right end in FIG. 4) of the spindle 21. A substantially C-shaped traveler 27 is mounted for movement on the ring 26. Thus, the untwisted yarns A wound on the bobbins 2 are drawn out via the travelers 27 and are introduced to the weaving machine 3 past yarn guides (not shown) and warp yarn arranging rollers 40 on the creel.

The motor 6 for driving the creel includes a power supply unit which automatically operates and stops in response to operation and stopping of the weaving machine 3. It is to be noted that if the motor 6 is of the type which incorporates a brake therein, it can be synchronized perfectly with operation and stopping of the weaving machine 3.

When the spindle 21 rotates one full rotation, the ring 26 and the bobbin 2 secured to the spindle 21 are also rotated one complete rotation, and as the bobbin 2 is rotated, the untwisted yarn A is unwound from the bobbin 2 and drawn out via the traveler 27 while it is twisted at a same time. In this instance, the traveler 27 travels on the ring 26 in accordance with the length of the yarn (untwisted yarn A) thus drawn out thereby to maintain the yarn drawing out tension (unwinding tension) constant.

The rotational speed or frequency of the bobbins 2 can be varied by the speed change gear 7 described hereinabove, and the higher the rotational speed, the more the number of twists per unit length, and accordingly the lower the rotational speed on the contrary, the less the number of twists per unit length of the yarns.

Meanwhile, the weaving machine 3 further includes a plurality of healds 41 and a reed 42 as shown in FIG. 1.

Now, operation of the creel of the embodiment described above will be described.

If the motor 6 is activated, rotation of the motor 6 is transmitted to the spindles 21 via the speed change gear 7, intermediate pulleys 14, 15, 16 and the spindle driving shafts 17, and consequently the bobbins 2 and the rings 26 are rotated by the spindles 21. In this instance, each time the bobbins 2 and the rings 26 are rotated one complete rotation, a twist of one complete turn is applied to the untwisted yarns A drawn out from the bobbins 2.

Since a woven fabric during operation of the weaving machine 3 is wound up at a fixed speed by the take-up roller 4 and consequently the length of the warp yarns drawn out thereby is constant, where the warp yarns are drawn out, for example, by 2 meters for one minute, rotation of the spindles 21 (bobbins 2) by 200 rotations for one minute will apply twists of 100 t/m to each of the warp yarns. Since the rotational speed or frequency of the spindles 21 can be set arbitrarily by the change gear 7, the degree of twist can be changed readily.

The warp yarns which have been twisted in this manner are then introduced to the yarn arranging rollers 40 by the yarn guides and thus arranged with uniform tensile forces by the yarn arranging rollers 40 and are then supplied to the weaving machine 3 on which they are woven into a textile fabric which is subsequently wound up by the take-up roller 4.

While a traveler in a conventional ring twisting machine rotates at a very high speed on a ring, the untwisted yarns A and the rings 26 in the mechanism described above are rotated at a same speed. Accordingly, the travelers 27 must only move together with the untwisted yarns A on the ring 26 by a length equal to the length of the untwisted yarns A drawn out during one complete rotation of the rings 26 in a direction (unwinding direction) opposite to the winding direction of the untwisted yarns A. In the case of the example described above, in order to produce twists of 100 t/m at a yarn speed of 2 m/min by rotation of the spindles 21 at a rotational frequency of 200 rpm, each traveler 27 must only move by a distance of 10 mm on the associated ring 26. Where the diameter of the ring 26 is 250 mm, the time required for the traveler 27 to move along the ring 26 once is about 23.6 seconds or so and is thus very slow. Accordingly, such a precise ring having an oiling mechanism as is employed in a conventional ring twisting machine is not required, and only a simple mechanism is required.

Figure 3:
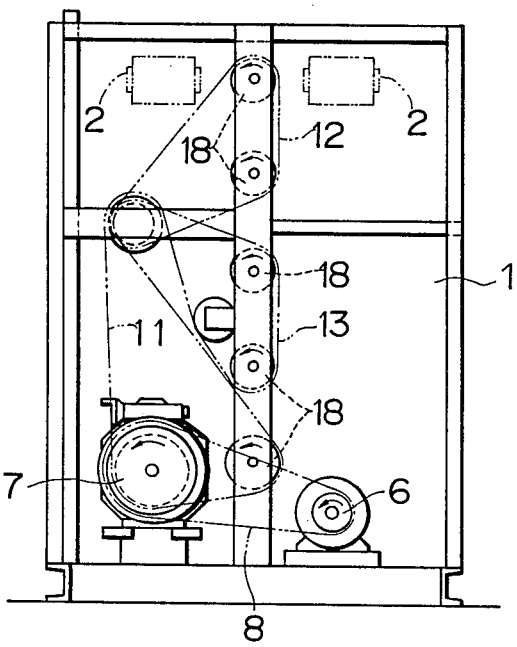
FIG. 3 is a side elevational view of the creel of FIG. 1.
Figure 5:
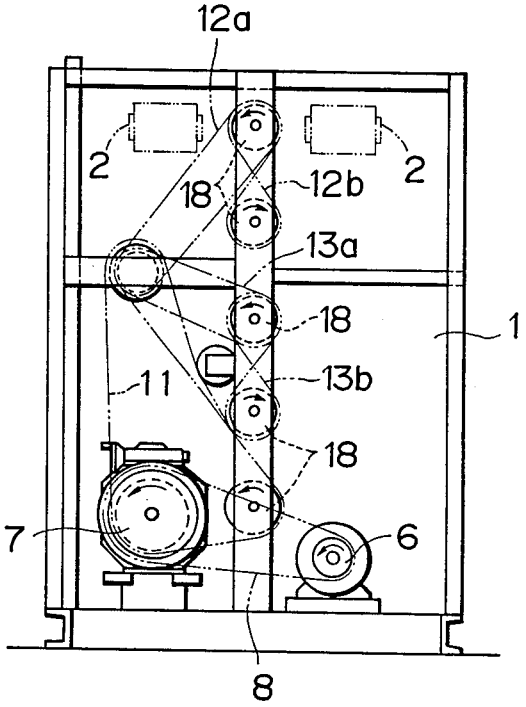
FIG. 5 is a view similar to FIG. 3 but showing a creel according to another embodiment of the invention.

FIG. 5 shows a creel according to a second embodiment of the present invention and is a view similar to FIG. 3 which shows the creel of the first embodiment of the invention. It is to be noted that like parts or components are denoted by like reference numerals or symbols to those of FIGS. 1 to 4 and detailed description thereof is omitted herein to avoid redundancy.

Raw yarns supplied from a maker are normally wound in a fixed direction on bobbins (straight paper spools) 2, and such untwisted yarns A are unwound in a clockwise direction or in a counterclockwise direction from the bobbins 2 depending upon whether the bobbins 2 are fitted on the support tubes 24 in a regular direction or in a reverse direction.

In the creel of the second embodiment of the invention shown in FIG. 5, bobbins 2 to be mounted on the first, third and fifth horizontal frames **5*b* (refer to FIG. 1) are fitted in the regular direction onto the individual support tubes 24 so that untwisted yarns A on the bobbins 2 may be unwound in the clockwise directions while bobbins 2 to be mounted on the second and fourth horizontal frames 5*b* are fitted in the reverse direction onto the support tubes 24** so that untwisted yarns A may be unwound in the counterclockwise direction.

Meanwhile, rotation transmitted from the motor 6 to the pulley 10 via the speed change gear 7 is transmitted via belts **11, 12*a*, 12*b*, 13*a*, 13*b* and intermediate pulleys 14, 15, 16 (refer to FIG. 2) located at a substantially mid height of the one side of the creel body 1 to the pulleys 28 located adjacent and extending along the horizontal frames 5*b* so that the individual spindle driving shafts 17 are driven to rotate thereby. Thus, the spindle driving shafts 17 rotate the bobbins 2 in a direction to unwound the untwisted yarns A from the bobbins 2. Accordingly, the spindle driving shafts 17 on the first, third and fifth horizontal frames 5*b* are rotated in the clockwise direction because the untwisted yarns A on the bobbins 2 on the first, third and the fifth horizontal frames 5*b* are unwound from the bobbins 2 when they are rotated in the clockwise direction, but to the contrary the spindle driving shafts 17 on the second and fourth horizontal frames 5*b* are rotated in the counterclockwise direction because the untwisted yarns A on the bobbins 2 on the second and fourth horizontal frames 5*b* are unwound from the bobbins 2** when they are rotated in the counterclockwise direction.

Thus, in the embodiment shown in FIG. 5, the belts are arranged such that the spindle driving shafts 17 on the first, third and fifth horizontal frames **5*b* may be rotated in the clockwise direction and the spindle driving shafts 17 on the second and fourth horizontal frames 5*b* may be rotated in the counterclockwise direction. However, the creel may otherwise include two motors and two speed change gears with one of the two motors and its associated speed change gear connected to rotate the spindle driving shafts 17 on the first, third and fifth horizontal frames 5*b* in the clockwise direction while the other change gear and its associated speed change gear are connected to rotate the spindle driving shafts 17 on the second and fourth horizontal frames 5*b*** in the counterclockwise direction.

Also in the case of the second embodiment, each time the bobbins 2 and the rings 26 are rotated one complete rotation, a twist of one turn is applied to the untwisted yarns A drawn out from the bobbins 2 in a similar manner as in the first embodiment. In this instance, however, the untwisted yarns A are unwound in the clockwise direction from the bobbins 2 on the first, third and fifth horizontal frames **5*b* and are thus twisted in the S twist while the untwisted yarns A are unwound in the counterclockwise direction from the bobbins on the second and fourth horizontal frames 5*b*** and are thus twisted in the Z twist.

Accordingly, in a textile fabric in the form of a belt woven on the weaving machine 3, warp yarns of the S twist and those of the Z twist are arranged in an alternate relationship. Therefore, although each warp yarn in the belt-formed textile fabric tends to distort the textile fabric due to its twist, distortion by the warp yarns of the S twist and distortion by the warp yarns of the Z twist will cancel each other so that the textile fabric will maintain its regular undistorted state.

It is to be noted that while in the present embodiment the creel includes the five horizontal frames **5*b* so that warp yarns A of the S twist may be supplied from bobbins 2 on the first, third and fifth horizontal frames 5*b* and warp yarns A of the Z twist may be supplied from bobbins 2 on the second and fourth horizontal frames 5*b* to the weaving machine, if the creel is modified such that it includes an even number of such horizontal frames 5*b* so that warp yarns of the S twist and a same number of warp yarns of the Z twist may be supplied to the weaving machine 3**, possible distortion of a product textile fabric can be canceled more perfectly.

Having now fully described the invention, it will be apparent to one of ordinary skill in the art that many changes and modifications can be made thereto without departing from the spirit and scope of the invention as set forth herein.

What is claimed is:

1. A creel arrangement for unwinding and twisting yarns supplied from a plurality of bobbins each containing untwisted yarn, comprising:

(a) frame means for defining a creel body;

(b) a plurality of spindles mounted for rotation on the frame means to support said bobbins co-rotatable thereon;

(c) a ring frame and a ring concentrically mounted on a spindle surrounding the bobbin and a traveler mounted for movement on each ring; and (d) driving means and means driven by the driving means for rotating each said spindle, ring frame, ring, and bobbin and traveler on the ring such that the untwisted yarn is unwound from the rotating bobbin by the associated traveler, a twist is simultaneously applied to the yarn.

2. A textile fabric manufacturing apparatus, comprising;

(a) a creel arrangement for unwinding and twisting yarns supplied from a plurality of bobbins containing untwisted yarn, said creel arrangement including:

(i) frame means for defining a creel body;

(ii) a plurality of spindles mounted for rotation on the frame means to support said bobbins co-rotatable thereon;

(iii) a ring frame and a ring concentrically mounted on a spindle surrounding the bobbin and a traveler mounted for movement on each ring; and (iv) driving means and means driven by the driving means for rotating each said spindle, ring frame, ring, and bobbin and traveler on the ring such that the untwisted yarn is unwound from the rotating bobbin by the associated traveler, a twist is simultaneously applied to the yarn;

(b) warp yarn arranging rollers mounted on the creel body; and (c) a weaving machine receiving twisted yarn from said rollers at a supply speed substantially the same as a weaving speed of the weaving machine.

3. The creel arrangement of claim 1, wherein said driving means includes means enabling adjustment of the rotational speed of said spindles.

4. The textile fabric manufacturing apparatus of claim 2, wherein said driving means includes means enabling adjustment of the rotational speed of said spindles.

5. The creel arrangement of claim 1, wherein said rotating means driven by said driving means rotates a predetermined number of said spindles in a clockwise direction so that when untwisted yarns are unwound from bobbins supported on said predetermined spindles via the associated travelers an S-twist is applied simultaneously to the unwinding untwisted yarns, with the remaining ones of said spindles other than said predetermined spindles rotating in a counter-clockwise direction such that when the untwisted yarns are unwound from the bobbins supported on the remaining ones of said spindles via the associated travelers, a Z-twist is applied simultaneously to the unwinding, untwisted yarns.

6. The creel arrangement of claim 5, wherein said predetermined spindles and said remaining spindles are alternatingly disposed in relation to each other.

7. The textile fabric manufacturing apparatus of claim 2, wherein said rotating means driven by said driving means rotates a predetermined number of said spindles in a clockwise direction so that when untwisted yarns are unwound from bobbins supported on said predetermined spindles via the associated travelers an S-twist is applied simultaneously to the unwinding untwisted yarns, with the remaining ones of said spindles other than said predetermined spindles rotating in a counter-clockwise direction such that when the untwisted yarns are unwound from the bobbins supported on the remaining ones of said spindles via the associated travelers, a Z-twist is applied simultaneously to the unwinding, untwisted yarns.

8. The textile fabric manufacturing apparatus of claim 7, wherein said predetermined spindles and said remaining spindles are alternatingly disposed in relation to each other.

* * * * *